United States Patent [19]

Harper

[11] 4,282,457

[45] Aug. 4, 1981

[54] BACKWARD WAVE SUPPRESSOR

[75] Inventor: Robert Harper, Concord, Mass.

[73] Assignee: Raytheon Company, Lexington, Mass.

[21] Appl. No.: 49,378

[22] Filed: Jun. 18, 1979

[51] Int. Cl.[3] ..... H01J 25/34

[52] U.S. Cl. ..... 315/3.6; 315/3.5; 315/39.3

[58] Field of Search ..... 315/3.6, 3.5, 3.15, 315/39.3

[56] References Cited

U.S. PATENT DOCUMENTS

| | | | |
|---|---|---|---|
| 2,905,858 | 9/1959 | Cutler | 315/3.6 X |
| 2,994,008 | 7/1951 | Geiger et al. | 315/3.5 |
| 3,020,498 | 2/1962 | Ash et al. | 315/3.6 |
| 3,271,615 | 9/1966 | Washburn, Jr. | 315/3.5 |
| 3,293,482 | 12/1966 | Wolkstein | 315/3.6 |
| 3,414,844 | 12/1968 | Putz | 315/3.6 X |
| 3,654,565 | 4/1972 | Jasper, Jr. | 315/3.6 |
| 3,980,920 | 9/1976 | Dudley et al. | 315/3.6 |
| 4,158,791 | 6/1979 | Lien et al. | 315/3.6 |

*Primary Examiner*—Saxfield Chatmon, Jr.

*Attorney, Agent, or Firm*—Martin M. Santa; Joseph D. Pannone

[57] ABSTRACT

A traveling wave tube (TWT) has a slow wave structure in the form of a helix for amplifying the forward electromagnetic wave. The TWT is provided with an outer slow wave assembly for attenuating a backward wave to provide stability to the TWT. A set of ceramic rods are uniformly spaced circumferentially around the helix for supporting the outer slow wave assembly which is formed by an electrically conducting wire wound around the supporting rods. The wire is wound in a helical fashion with individual turns of the helix being spaced apart to form the outer slow wave structure. An electrically conducting cylinder surrounds the outer slow wave structure and is in contact therewith only at the sites of the rods. Dielectric slabs, having a slow wave structure such as a meander line disposed thereon, are inserted periodically around the outer slow wave structure in spaces between the winding and the cylinder. The spacing between the turns of the winding is selected for coupling a backward wave of a specific frequency to the dielectric slabs for attenuation of the backward wave.

15 Claims, 5 Drawing Figures

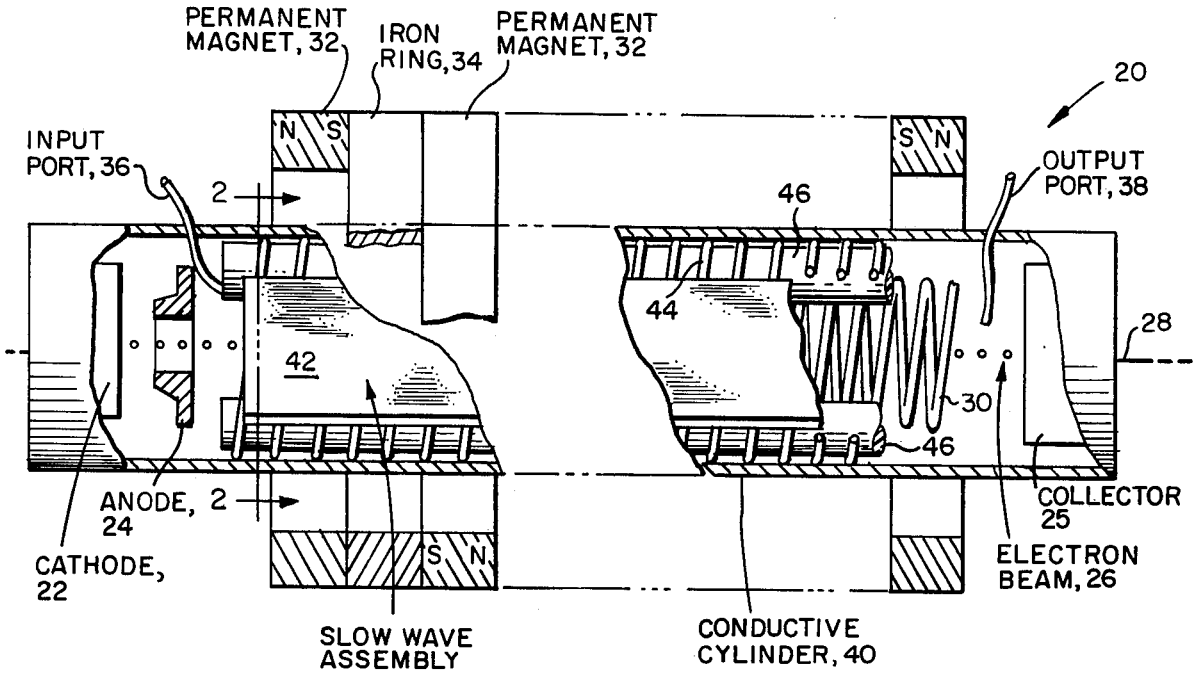
FIG. 1
FIG. 4
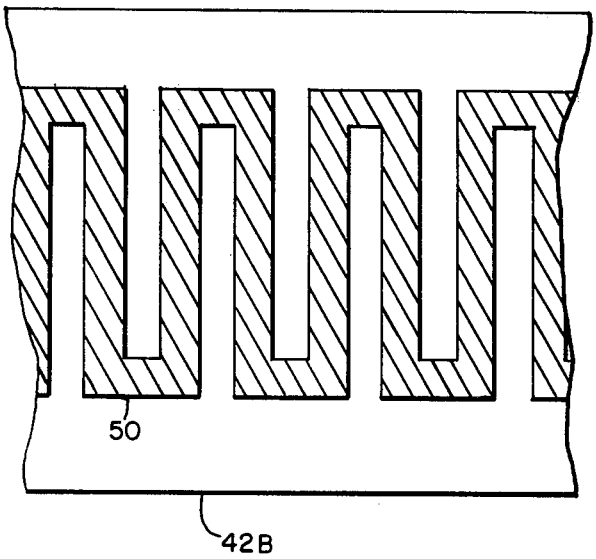

BACKWARD WAVE SUPPRESSOR

BACKGROUND OF THE INVENTION

Traveling wave tubes (TWT's) are utilized as power amplifiers at microwave frequencies for both radar and communications systems. A TWT is frequently built with a slow wave structure in the form of a helix, and with cathode and anode assemblies disposed at the ends of the helix for generating an electron beam which travels along the axis of the helix. Focussing of the beam is accomplished with an array of periodic permanent magnets which are of a toroidal shape for enclosing the helix and are positioned sequentially along the helical axis. The electron beam interacts with electromagnetic waves propagating along the helix to amplify the wave. One such wave, known as the fundamental wave, travels in the same direction as the electron beam, the forward direction, and is utilized for amplification of electric signals.

The helix also supports waves in the reverse direction, the backward waves. At a specific frequency which is greater than the normal amplification frequency band of the TWT, the backward wave can interact with the electron beam and extract energy therefrom, the extracted energy being transferred back toward the cathode assembly. Such transferrence of energy can introduce instabilities and oscillations to the TWT when the power of the backward wave is excessive. Various structures have been employed, such as resistive coatings and waveguide-type structures tuned to the backward wave frequency, for attenuating the backward wave so that the foregoing instabilities and oscillations do not occur.

A problem arises in that the structures which may be utilized in attenuating the backward wave are excessively large relative to the size of the helix to admit the mounting of the structures within the confines of the array of the permanent magnets utilized for the beam focussing.

SUMMARY OF THE INVENTION

The foregoing problem is overcome and other advantages are provided by a backward wave suppressor which, in accordance with the invention, has a physical size and shape which permits the suppressor to be tuned to a desired frequency of the backward wave, and to be fitted circumferentially around the helix of a TWT and within the central apertures of the array of permanent magnets which focus the electron beam. The invention provides for a set of insulating rods of a ceramic or dielectric material which are uniformly spaced circumferentially around the helix with axes of the rods being disposed lengthwise along the helix. An electrically conducting wire is wound in helical fashion about the rods, the turns of the winding being spaced apart so as to provide a slow wave structure for interaction with the backward wave having the frequency at which instabilities may occur. In a preferred embodiment of the invention, three rods have been utilized, the axes of the rods being parallel to the axis of the helix, this providing a cross-sectional view of the winding having the appearance of an equilateral triangle with rounded vertices.

The foregoing assembly of the helix and outer winding are inserted within an electrically conducting cylinder, such as a cylinder of copper, the inner surface of the cylinder contacting the vertices of the winding and being spaced apart from the winding at locations between the vertices. The length of each wire segment of the winding, corresponding to a side of the aforementioned triangle, is no more than approximately one-quarter of a wavelength of radiation at the frequency of the forward fundamental wave, but is equal to approximately one-half length of radiation at the higher frequency of the backward wave. Thereby, the succession of wire segments between any pair of the rods, in conjunction with the conducting wall of the cylinder, provides a slow wave structure which interacts with the backward wave. In the foregoing example of the triangular arrangement of three rods, there are three such slow wave structures. In the event that four or more rods were utilized, correspondingly, four or more such slow wave structures would be produced. Virtually no interaction is obtained between the set of slow wave structures and the forward wave because of its relatively low frequency. Preferably, a set of dielectric slabs is employed for absorbing energy of the backward wave, one slab being enclosed within each of the slow wave structures, the slab being located between the wire segments and the inner surface of the cylinder. A printed slow wave circuit, such as a meander line, may be provided on the surface of the slab for interacting with the backward wave to absorb power therefrom. Thereby, the slow wave structures and their included slabs serve as the backward wave suppressor for directing energy of the backward wave into the slab where it is attenuated, while the forward wave is left essentially undisturbed.

BRIEF DESCRIPTION OF THE DRAWINGS

The aforementioned aspects and other features of the invention are explained in the following description taken in connection with the accompanying drawings, wherein:

FIG. 1 is a side view of a TWT incorporating the backward wave suppressor of the invention with portions of the TWT being shown diagrammatically, a permanent magnet structure and a cylinder thereof being cut away to expose a slow wave structure and its slab which form a part of the backward wave suppressor;

FIG. 4 is an alternative embodiment of the slab of FIG. 3 showing a meander line configuration on the surface of the slab.

DESCRIPTION OF THE PREFERRED EMBODIMENT

Figure 2:
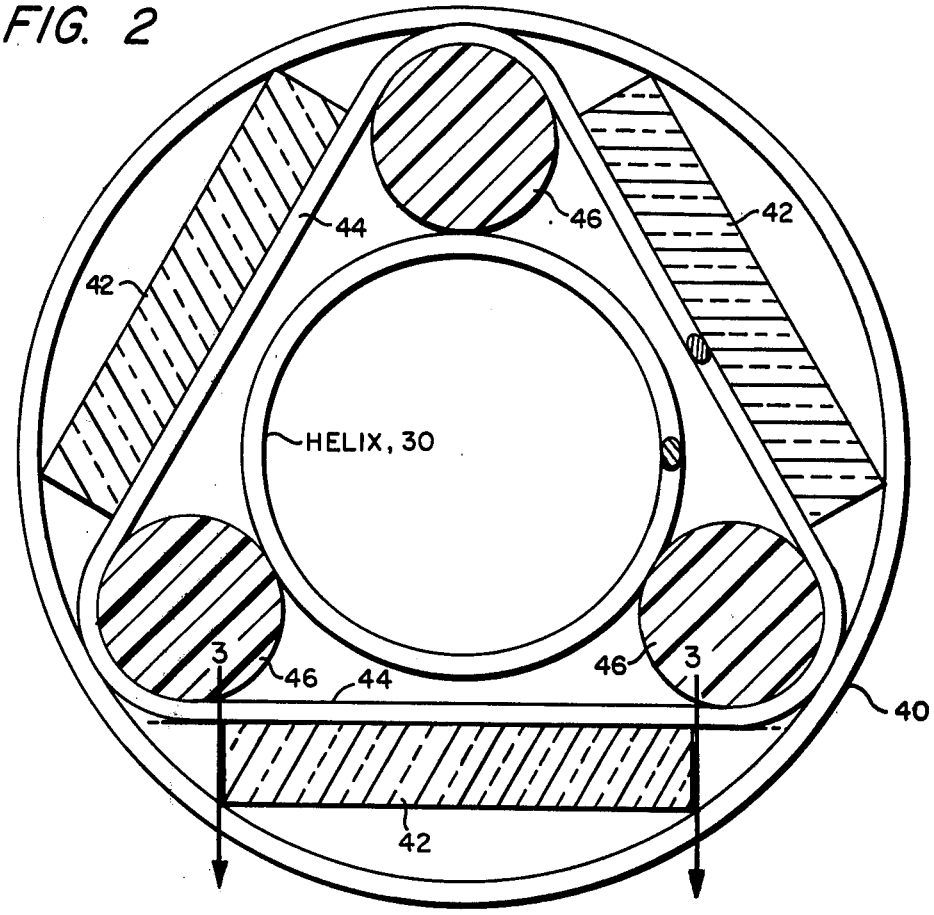
FIG. 2 is a cross-sectional view of the helix and slow wave structures taken along the line 2—2 of FIG. 1.

Referring to FIGS. 1 and 2 there is seen a TWT 20 comprising a cathode 22 which is shown diagrammatically and is understood to include the assembly of the focussing electrodes, an anode 24, and a collector 25 which is shown diagrammatically, the collector 25 being understood to include a heat sink. The cathode 22 and the anode 24 provide an electron beam 26 along an axis 28 of a slow wave structure shown as a helix 30. The beam 26 is focussed in a conventional manner by a set of permanent magnets 32 having a toroidal form and interleaved between rings 34 which are shown in simplified form, the rings 34 being of a magnetizable material such as iron for shaping the magnetic field. An input port 36 and an output port 38 are represented diagrammatically as antenna elements, and are positioned, respectively, at the front end and the back end of the helix 30 for coupling electromagnetic energy to the helix 30 and from the helix 30, respectively. Electromagnetic energy coupled by the input port 36 advances along the helix 30 as a forward fundamental wave and interacts with the beam 26 to provide an amplified wave which is coupled from the helix 30 at the output port 38.

In accordance with the invention, the TWT 20 further comprises a cylinder 40, slabs 42, a winding 44 and support rods 46 which form a slow wave structure for suppressing a backward wave at a frequency wherein the backward wave would interact with the beam 26 to produce instability and oscillation in the operation of the TWT 20. By way of example, three rods 46 are depicted in the figures giving a cross-sectional shape to the winding 44 of a regular polygon having rounded vertices. If desired, four or more of the rods 46 may be utilized to provide the winding 44 with a polygonal shape of four or more segments. In the geometry of the arrangement of FIG. 2, each segment of the winding 44 may be regarded as a chord of the included arc of the cylinder 40. The three segments shown in FIG. 2 are spaced apart from the cylinder 40 at their midpoints and contact the cylinder 40 at their ends, thereby providing a space between the segments and the inner wall of the cylinder 40 for the slabs 42. While the rods 46 may have their axes inclined slightly with respect to the axis 28 of the helix 30, thereby spiraling about the helix 30, the preferred embodiment of the invention has utilized a simpler construction wherein the axes of the rods 46 are parallel to the axis 28, as seen in FIG. 3.

In constructing the winding 44, the three rods 46 are placed alongside and in contact with the helix 30. Then a wire of an electrically conducting material, such as copper, is wound around the rods 46 with spaced-apart turns, as seen in FIG. 1, the diameter of the wire and the spacing between the turns of the winding 44 being selected in accordance with the frequency of the backward wave which is to be suppressed. Both the helix 30 and the cylinder 40 are constructed of an electrically conductive material such as copper. Both the rods 46 and the slabs 42 are constructed of an insulating material with dielectric properties, a ceramic such as alumina having been utilized in the preferred embodiment. In the event that copper is used in the winding 44, the copper is plated with silver and then the assembly of FIG. 2 is placed in a brazing oven for brazing the winding 44 to the cylinder 40. To accommodate high temperatures, the helix 30 and the winding 44 of the preferred embodiment have been fabricated of tungsten wire with a gold coating, the gold providing a braze of the winding 44 to the cylinder 40 at a brazing temperature of approximately 1000° C. In addition, the gold flows at the brazing temperature to produce a uniform coating around the tungsten wire at a thickness of a few ten-thousandths of an inch, which thickness is in excess of the skin depth of the radiation penetration at the frequencies of interest, above 10 GHz (gigahertz). Thereby, the gold serves as both a conductor and as a brazing element.

Each segment of the winding 44 in combination with the adjoining arcuate region of the cylinder 40 provides a slow wave structure which is propagative of the backward wave which is to be suppressed. The slab 42 is fabricated with a coating of carbon particles, or by impregnating carbon particles within the alumina matrix, so as to be resistive and dissipative of electromagnetic energy traveling through the slow wave structure and permeating the slab 42. The slow wave structure is a set of parallel segments of the form known as a ladder line in which the dimensions and spacing of the elements are selected in accordance with the desired frequency to be propagated, such a structure being described in the text "Microwave Engineering," by Harvey, published in 1963 by the Academic Press, New York, pages 466–469. By way of example, assuming that the helix 30 has been designed in accordance with conventional practice and has a diameter and pitch for amplification of fundamental forward waves in the range of 15–25 GHz, the backward wave oscillation frequency, which is to be suppressed, would be approximately 39 GHz. The pitch of the wires of the winding 44, in combination with the loading the dielectric slab 42 is selected to provide a velocity for propagation of the backward wave frequency along the slow wave structure equal to the phase velocity of such wave propagating along the helix 30. The electric field of the backward wave is found within the region between the segment of the winding 44 and the inner wall of the cylinder 40 for each of the slow wave structures and, accordingly, can interact with the material of the slabs 42 for dissipating energy of the backward wave within the slabs 42.

Figure 3:
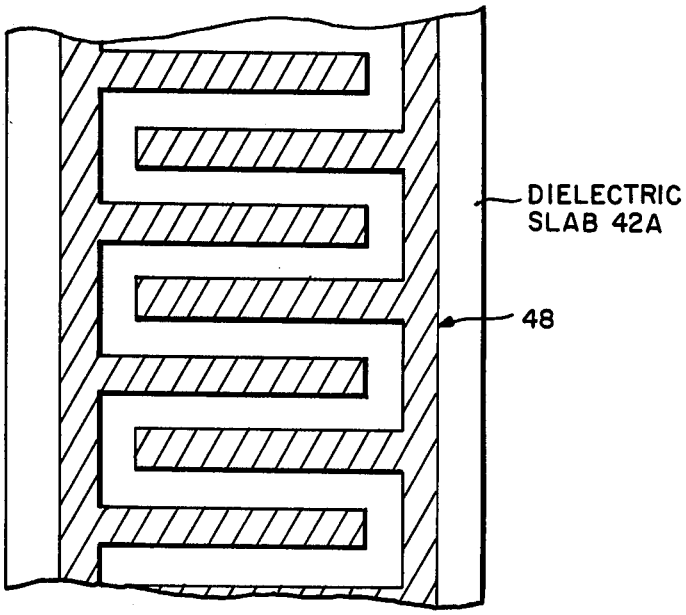
FIG. 3 is a plan view of a slab of FIGS. 1 and 2 having an interdigital slow wave line on its surface, the view of FIG. 3 being taken along the line 3—3 of FIG. 2.

Referring now to FIG. 3, there is seen an alternative embodiment of a slab, identified by the legend 42A, wherein an interdigital line 48 is placed on the surface of the slab 42A, for example, by photolithographic techniques. The interdigital line 48 faces the winding 44 of FIG. 2, and is constructed of an electrically conducting material such as copper to provide a slow wave structure. The fingers of the line 48 are spaced with a spacing approximating the spacing between turns of the winding 44, in the range from one-half to twice the spacing of the turns of the winding 44, to provide a phase velocity along the line 48 which approximates the phase velocity of the backward wave along the winding 44.

Referring to FIG. 4, there is seen an alternative embodiment of a slab, identified by the legend 42B, wherein a meander line 50 is deposited on the surface of the slab 42B facing the winding 44 of FIG. 2, the line 50 functioning in the same manner as the line 48 of FIG. 3 to provide a slow wave structure wherein the phase velocity of the backward wave is approximately the same as that of the wave propagating along the winding 44. The line 48 of FIG. 3, as well as the line 50 of FIG. 4, provide for a coupling of the backward wave directly at the surface of the respective slabs 42A and 42B for the extraction of power from the backward wave and the resultant suppression of the backward wave. The spacing of the legs of the line 50 of FIG. 4 falls within the range of one-half to twice the spacing of the turns of the winding 44. If desired, resistive material may be utilized in the lines 48 and 50 to provide resistive losses to currents induced within the lines 48 and 50 for enhancing suppression of the backward wave.

Figure 5:
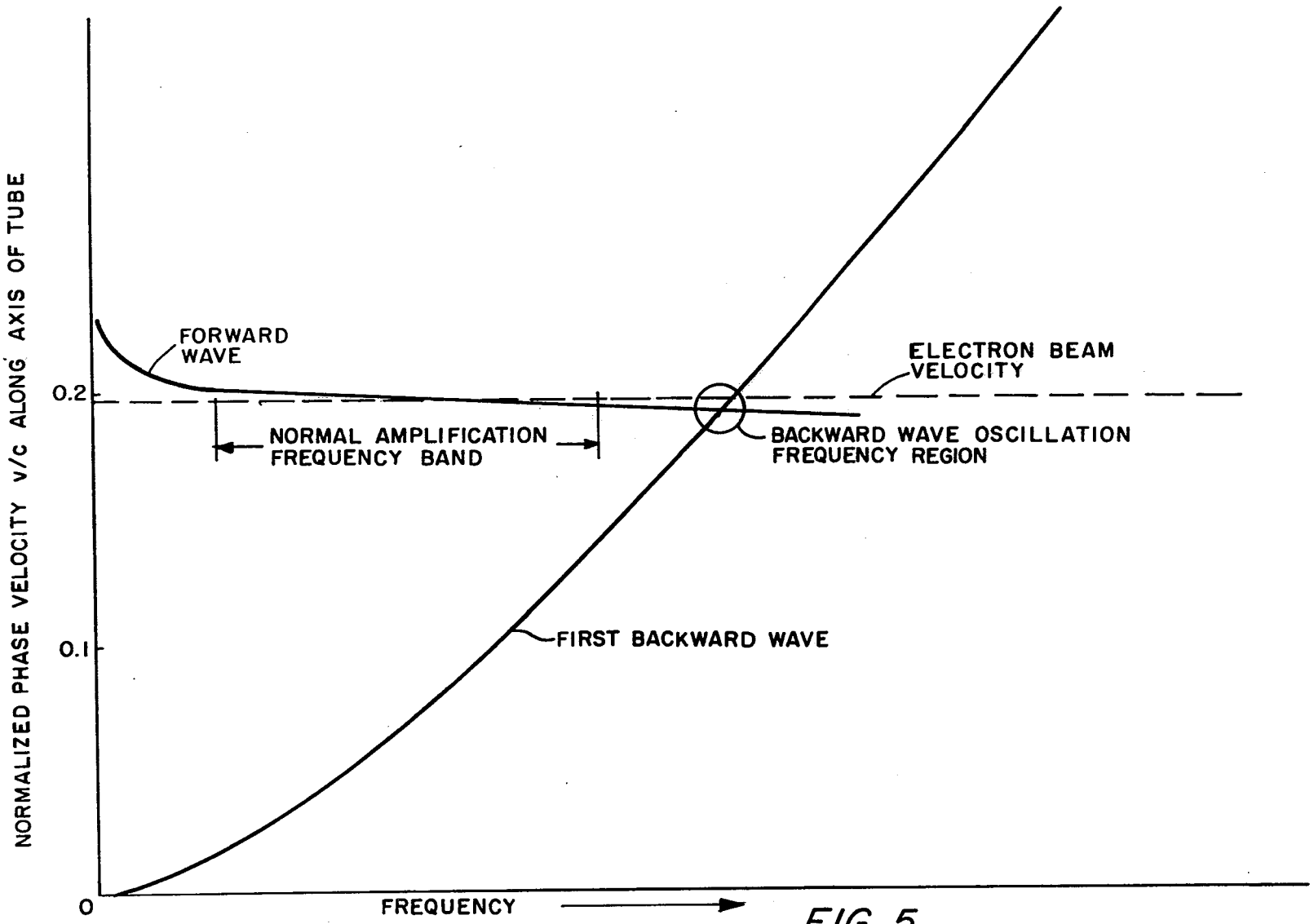
FIG. 5 is a diagram of wave propagation velocity versus frequency.

Referring now to FIG. 5, the diagram shows the component of phase velocity, as measured in the direction of the axis 28 of FIG. 1, as a function of frequency for a forward wave and a backward wave propagating along the helix 30 of FIGS. 1 and 2. The normalized velocity is shown in FIG. 5, the normalization being accomplished by dividing the velocity, v, by c, the speed of light. The normalized velocity of the forward wave, $V_f$, is seen to decrease slowly with increasing frequency, while the normalized velocity of the backward wave, $V_b$, increases rapidly with frequency. $V_f$ is approximately equal to the electron beam velocity over the frequency band normally used for amplification by the TWT 20. In the absence of the suppression structure of the invention, oscillation takes place at a frequency approximately equal to that at the crossover point of the graphs of $V_f$ and $V_b$, the oscillation frequency being between the foregoing crossover point and the crossover point of the graph $V_b$ with the electron beam velocity. The dimensions of the helix 30, and the winding 44 of FIG. 2 are set in accordance with the values of frequency for the amplification band and for the oscillation. The design of helices and other components of a travelling wave tube are described in the text "Power Travelling Wave Tubes" by J. F. Gittins, published by the American Elsevier Publishing Company in 1965. For amplification bands such as the foregoing exemplary amplification band of 15–25 GHz, typical diameters of the cylinder 40 of FIG. 2 would be in the range of approximately 2.5–5.0 millimeters. The helix 30 would have approximately 10 turns per centimeter and the winding 44 would have approximately 35 turns per centimeter as measured along the axis 28.

It is understood that the above-described embodiments of the invention are illustrative only and that modifications thereof may occur to those skilled in the art. Accordingly, it is desired that this invention is not to be limited to the embodiment disclosed herein, but is to be limited only as defined by the appended claims.

What is claimed is:

1. A traveling wave tube comprising:

a first slow wave low-loss structure having a longitudinal axis coincident with the longitudinal axis of said tube;

a second slow wave non-lossy structure positioned outside the first slow wave structure and coaxial therewith;

a set of insulating supports positioned between said first slow wave structure and said second slow wave structure for supporting said second slow wave structure at circumferentially spaced points;

an outer conducting tube enclosing said second slow wave structure and electrically contacting said circumferentially spaced points of said second slow wave structure to form transverse segments of said second slow wave structure extending transversely to said axis between said spaced-apart points each segment being spaced from said outer conducting tube except where said segments and said tube are in electrical contact; and at least one electrically lossy dielectric slab;

said slab being positioned in the space between said second slow wave structure segments and said conducting tube;

the lossy slab being dissipative to the electromagnetic energy of the frequency to which said transverse segments of said second slow wave structure are responsive.

2. A traveling wave tube according to claim 1 wherein said slabs include resistive material.

3. A traveling wave tube according to claim 1 further comprising a slow wave structure deposited on a surface of one of said slabs.

4. A traveling wave tube according to claim 1 wherein said segments of said second slow wave structure are less than quarter wavelength of radiation at the frequency of a forward fundamental wave to be amplified by said traveling wave tube, thereby providing minimal interaction of said fundamental wave with said second slow wave structure while permitting a maximum interaction of a backward wave at a higher frequency than said fundamental wave with said second slow wave structure.

5. A wave suppressor comprising:

an electrically conducting cylindrical member having a longitudinal axis;

a plurality of sets of longitudinally-spaced electrically conductive non-lossy transverse members, each of said sets of tranverse members being spaced from each other along the circumference of said cylindrical member, said transverse members of each of said sets being electrically connected to said cylindrical member at said members' ends, each set of members extending in the longitudinal direction; and slabs of lossy material for absorbing energy of a wave to whose frequency said transverse members are resonant, said slabs being positioned between said sets of transverse members and said cylindrical member and electromagnetically coupled to a wave to which said transverse members are resonant.

6. A wave suppressor according to claim 5 further comprising a slow wave structure deposited on a surface of at least one of said slabs.

7. A traveling wave tube comprising:

a first slow wave structure having a longitudinal form about an axis thereof;

a second slow wave non-lossy structure positioned outside the first slow wave structure and electromagnetically coupled therewith;

said second slow wave structure having laterally-extending longitudinally-spaced electrically conducting portions;

an outer conducting tube enclosing said second slow wave structure and electrically contacting the ends of said portions of said second slow wave structure to form spaces between said portions and said tube; and a set of electrically lossy dielectric slabs, each positioned in the spaces between said portions of said second slow wave structure and said conducting tube and electromagnetically coupled to said second slow wave structure to attenuate a frequency to which said second slow wave structure is responsive.

8. A traveling wave tube according to claim 7 wherein said slabs include resistive material.

9. A traveling wave tube according to claim 7 further comprising a third slow wave structure deposited on a surface of at least one of said slabs.

10. A traveling wave tube according to claim 7 wherein said segments of said second slow wave structure are less than quarter wavelength of radiation at the frequency of a forward fundamental wave to be amplified by said traveling wave tube, thereby providing minimal interaction of said fundamental wave with said second slow wave structure while permitting a maximum interaction of a backward wave at a higher frequency than said fundamental wave with said second slow wave structure.

11. A traveling wave tube comprising:

a first slow wave propagating means;

a second non-lossy slow wave propagating means electromagnetically coupled to said first slow means;

an electrically conducting cylinder surrounding said first and second slow wave propagating means;

an electrically lossy dielectric material disposed between said second slow wave propagating means and said cylinder;

said second slow wave propagating means being electromagnetically coupled to said dielectric material and said cylinder and being resonant at the frequency of the backward wave frequency and having a velocity for propagation of the backward wave frequency equal to the phase velocity of such said wave propagating along the first slow wave propagating means; and said second slow wave means coupling the energy of the backward wave frequency into said lossy dielectric material to suppress said backward wave frequency while shielding said first slow wave from said lossy dielectric material.

12. The traveling wave tube of claim 11 wherein said dielectric material has a surface in proximity to said first slow wave propagating means;

said second slow wave propagating means comprises a slow wave structure on said surface, said slow wave structure having a velocity for propagation of the backward wave frequency equal to the phase velocity of such said wave propagating along the first slow wave propagating means.

13. The traveling wave tube of claim 12 wherein said second slow wave propagating means further comprises a second slow wave structure between said first slow wave propagating means and said surface slow wave structure, said second slow wave structure being electromagnetically coupled to said first slow wave propagating means and said surface slow wave structure, said second slow wave structure having a velocity for propagation of the backward wave frequency equal to the phase velocity of such said wave propagating along the first slow wave propagating means.

14. The traveling wave tube according to claim 1 where said tube has a backward wave having a wavelength $\lambda$, wherein the electrical length of each segment of the second slow wave structure is substantially $\lambda/2$.

15. The wave suppressor of claim 5 wherein said transverse members has an electrical length which is substantially $\lambda/2$ where $\lambda$ is the wavelength of the wave to be suppressed.

* * * * *

UNITED STATES PATENT OFFICE

CERTIFICATE OF CORRECTION

Patent No. 4,282,457 Dated August 4, 1981

Inventor(s) Robert Harper

It is certified that error appears in the above-identified patent and that said Letters Patent are hereby corrected as shown below:

Column 5, line 14, insert --of-- after --graph--.

Signed and Sealed this

*Twentieth* Day of *April 1982*

[SEAL]

*Attest:*

GERALD J. MOSSINGHOFF

*Attesting Officer*

*Commissioner of Patents and Trademarks*